US010494061B2

(12) United States Patent
Fafard et al.

(10) Patent No.: US 10,494,061 B2
(45) **Date of Patent: *Dec. 3, 2019**

(54) RECONFIGURABLE SEATING FOR WATERCRAFT

(71) Applicant: Chaparral Boats, Inc., Nashville, GA (US)

(72) Inventors: Michael J. Fafard, Nashville, GA (US); Gerren Shea Smith, Alapaha, GA (US); Dale Norris Exum, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 19 days.

This patent is subject to a terminal disclaimer.

(21) Appl. No.: 15/698,863

(22) Filed: Sep. 8, 2017

(65) Prior Publication Data

US 2018/0229816 A1 Aug. 16, 2018

Related U.S. Application Data

(60) Provisional application No. 62/458,894, filed on Feb. 14, 2017.

(51) Int. Cl.
*B63B 29/04* (2006.01)

(52) U.S. Cl.
CPC ..... *B63B 29/04* (2013.01); *B63B 2029/043* (2013.01); *B63B 2709/00* (2013.01)

(58) Field of Classification Search
CPC ..... B63B 29/04; B63B 2029/043; B63B 2709/00
See application file for complete search history.

(56) References Cited

U.S. PATENT DOCUMENTS

| | | | | | |
|---|---|---|---|---|---|
| 425,483 | A * | 4/1890 | Arnold | A47C 17/207 | 297/110 |
| 2,969,107 | A * | 1/1961 | Naxon | A47C 17/1655 | 297/112 |
| 3,107,940 | A * | 10/1963 | Brooks | A47C 17/161 | 297/244 |
| 9,021,975 | B1 * | 5/2015 | Fodor | B63B 29/04 | 114/363 |
| 9,073,608 | B1 * | 7/2015 | Foss | B63B 29/04 | |
| 9,315,238 | B2 * | 4/2016 | Neese | A47C 7/40 | |
| 9,370,245 | B2 * | 6/2016 | Fafard | A47C 1/03211 | |
| 2018/0229816 | A1 * | 8/2018 | Fafard | B63B 29/04 | |
| 2018/0229817 | A1 * | 8/2018 | Fafard | B63B 29/04 | |

* cited by examiner

*Primary Examiner* — Philip F Gabler
(74) *Attorney, Agent, or Firm* — Fish & Richardson P.C.

(57) ABSTRACT

Boats can include seating assemblies that can be configured in a variety of different arrangements. In one configuration of the seating assemblies described herein, a forward-facing seat and a rearward-facing seat are arranged back-to-back. In another configuration, the seating assembly can be arranged as an essentially flat surface that can serve as an expansive sun bathing platform. In still another configuration, the seating assembly can be configured in a comfortable lounging arrangement that can be forward-facing or rearward-facing.

19 Claims, 5 Drawing Sheets

RECONFIGURABLE SEATING FOR WATERCRAFT

CROSS-REFERENCE TO RELATED APPLICATIONS

This application claims the benefit under 35 U.S.C. § 119(e) of U.S. Patent Application No. 62/458,894, entitled "RECONFIGURABLE SEATING FOR WATERCRAFT," filed Feb. 14, 2017. The disclosure of the foregoing application is incorporated herein by reference in its entirety for all purposes.

BACKGROUND

This document relates to seating assemblies for boats. For example, this document relates to seating assemblies that can be configured in a variety of different arrangements.

Recreational boating is a popular leisure activity in the United States. More than 87 million U.S. adults participated in recreational boating in 2014, using a boat for sports activities such as fishing and water skiing, and/or to travel. These boats are classified into several categories: sailboats, personal watercrafts, sterndrive boats, inboard boats, and outboard boats.

SUMMARY

This document describes seating assemblies for boats. For example, this document describes seating assemblies that can be configured in a variety of different arrangements. In one seating assembly configuration described herein, a forward-facing seat and a rearward-facing seat are arranged back-to-back. In another configuration, the seating assembly can be arranged as an essentially flat surface that can serve, for example, as an expansive sun bathing platform. In still another configuration, the seating assembly can be configured in a comfortable lounging arrangement that can be forward-facing or rearward-facing.

In one aspect, this disclosure is directed to a watercraft seating assembly. The watercraft seating assembly includes a seat bottom including an upper seating surface, and multiple seatback members that are reconfigurable between (i) forming back-to-back seats and (ii) forming a substantially flat surface. The multiple seatback members include a first seat back member movable in relation to the seat bottom and a second seatback member movable in relation to the seat bottom. While the multiple seatback members are forming the back-to-back seats, the first seat back member has a first seat back surface facing forward and a second seat back surface facing rearward. While the multiple seatback members are forming the back-to-back seats, the second seat back member has a third seat back surface facing forward and a fourth seat back surface facing rearward. While the multiple seatback members are forming the substantially flat surface, the upper seating surface, the second seat back surface, and the third seat back surface each comprise portions of the substantially flat surface.

Such a watercraft seating assembly may optionally include one or more of the following features. While the seating assembly is forming the substantially flat surface, the upper seating surface may be between the second seat back surface and the third seat back surface. While the seating assembly is forming the back-to-back seats, the second seat back surface may face the third seat back surface. The first seat back member and the second seat back member may be movable in relation to the seat bottom independently of each other. The first seat back member and the second seat back member may be each pivotable in relation to the seat bottom. While the seating assembly is forming the back-to-back seats, a forward portion of the upper seating surface and the first seat back surface may form a forward-facing seat, and a rearward portion of the upper seating surface and the fourth seat back surface may form a rearward-facing seat. The forward-facing seat and the rearward-facing seat each accommodate at least three seated passengers. The seating assembly may be configurable in a forward-facing lounge seat arrangement in which: (i) a forward portion of the upper seating surface and the second seat back surface comprise a substantially flat lounge seat surface and (ii) the third seat back surface comprises a lounge seat back. The seating assembly may be configurable in a rearward-facing lounge seat arrangement in which: (i) a rearward portion of the upper seating surface and the third seat back surface comprise a substantially flat lounge seat surface and (ii) the second seat back surface comprises a lounge seat back.

In another aspect, this disclosure is directed to a watercraft seating assembly. The watercraft seating assembly includes: (i) a seat bottom member; (ii) a first seat back member movable relative to the seat bottom member; and (iii) a second seat back member movable relative to the seat bottom member. The seating assembly is configurable in a substantially flat configuration in which the seat bottom member is disposed between the first and second seat back members. The seating assembly is also configurable as two back-to-back seats each comprising a portion of the seat bottom member and either the first seat back member or the second seat back member.

Such a watercraft seating assembly may optionally include one or more of the following features. The seating assembly may be reconfigurable from the substantially flat configuration to the back-to-back seats configuration by pivoting the first and second seat back members toward each other. The first and second seat back members may each pivot at least 60 degrees when reconfiguring from the substantially flat configuration to the back-to-back seats configuration. The seating assembly may be reconfigurable from the back-to-back seats configuration to the substantially flat configuration by pivoting the first and second seat back members away from each other. The first and second seat back members may each pivot at least 60 degrees when reconfiguring from the back-to-back seats configuration to the substantially flat configuration.

In another aspect, this disclosure is directed to a watercraft that includes a deck and a seating assembly attached to the deck. The seating assembly includes: (a) a seat bottom member; (b) a first seat back member movable relative to the seat bottom member; and (c) a second seat back member movable relative to the seat bottom member. The seating assembly is configurable in a substantially flat configuration in which the seat bottom member is disposed between the first and second seat back members. The seating assembly is also configurable as two back-to-back seats each comprising a portion of the seat bottom member and either the first seat back member or the second seat back member.

Such a watercraft may optionally include one or more of the following features. The two back-to-back seats may comprise a first seat that faces toward a front of the watercraft and a second seat that faces toward a rear of the watercraft. The seating assembly may extend laterally across a majority of a beam of the watercraft. One or more storage compartments may reside under the seat bottom member and above the deck. The watercraft may also include: one or more first motorized actuators that pivot the first seat back member when the seating assembly is reconfiguring between the back-to-back seats configuration and the substantially flat configuration; and one or more second motorized actuators that pivot the second seat back member when the seating assembly is reconfiguring between the back-to-back seats configuration and the substantially flat configuration. The first and second seat back members may each pivot at least 75 degrees when reconfiguring between the back-to-back seats configuration and the substantially flat configuration.

Particular embodiments of the subject matter described in this document can be implemented to realize one or more of the following advantages. First, in some implementations the seating assemblies described herein are highly versatile. As such, the seating assemblies can advantageously provide utility and enjoyment in a variety of circumstances. For example, the seating assemblies described herein can be configured as back-to-back seats, a sun bathing platform, and as lounge seating. Hence, the seating can be configured in a multitude of differing arrangements, however the user desires.

Second, in some embodiments the seating assemblies described herein can be constructed to have whatever width a user desires and/or whatever is suitable for a particular watercraft. Accordingly, the seating assemblies can be designed for a single occupant or for multiple occupants. In some embodiments, the seating assemblies can be constructed to laterally span a majority of, or even all of, a boat's beam distance.

Third, in some embodiments the seating assemblies described herein can be designed to facilitate storage under or within the seating assembly. In some embodiments, drawers under the seating assembly can be included. In particular embodiments, the seat bottom, or a portion thereof, can be movable to provide access to one or more storage areas incorporated into the seating assembly.

Other features, objects, and advantages of the invention will be apparent from the description and drawings, and from the claims.

The details of one or more embodiments of the invention are set forth in the accompanying drawings and the description herein.

Although methods and materials similar or equivalent to those described herein can be used to practice the invention, suitable methods and materials are described herein. In case of conflict, the present specification, including definitions, will control. In addition, the materials, methods, and examples are illustrative only and not intended to be limiting.

DESCRIPTION OF THE DRAWINGS

Like reference numbers represent corresponding parts throughout.

DETAILED DESCRIPTION

This document describes seating assemblies for boats. For example, this document describes seating assemblies that can be configured in a variety of different arrangements. In one seating assembly configuration described herein, a forward-facing seat and a rearward-facing seat are arranged back-to-back. In another configuration, the seating assembly can be arranged as an essentially flat surface that can serve, for example, as an expansive sun bathing platform. In still another configuration, the seating assembly can be configured in a comfortable lounging arrangement that can be forward-facing or rearward-facing.

Figure 1:
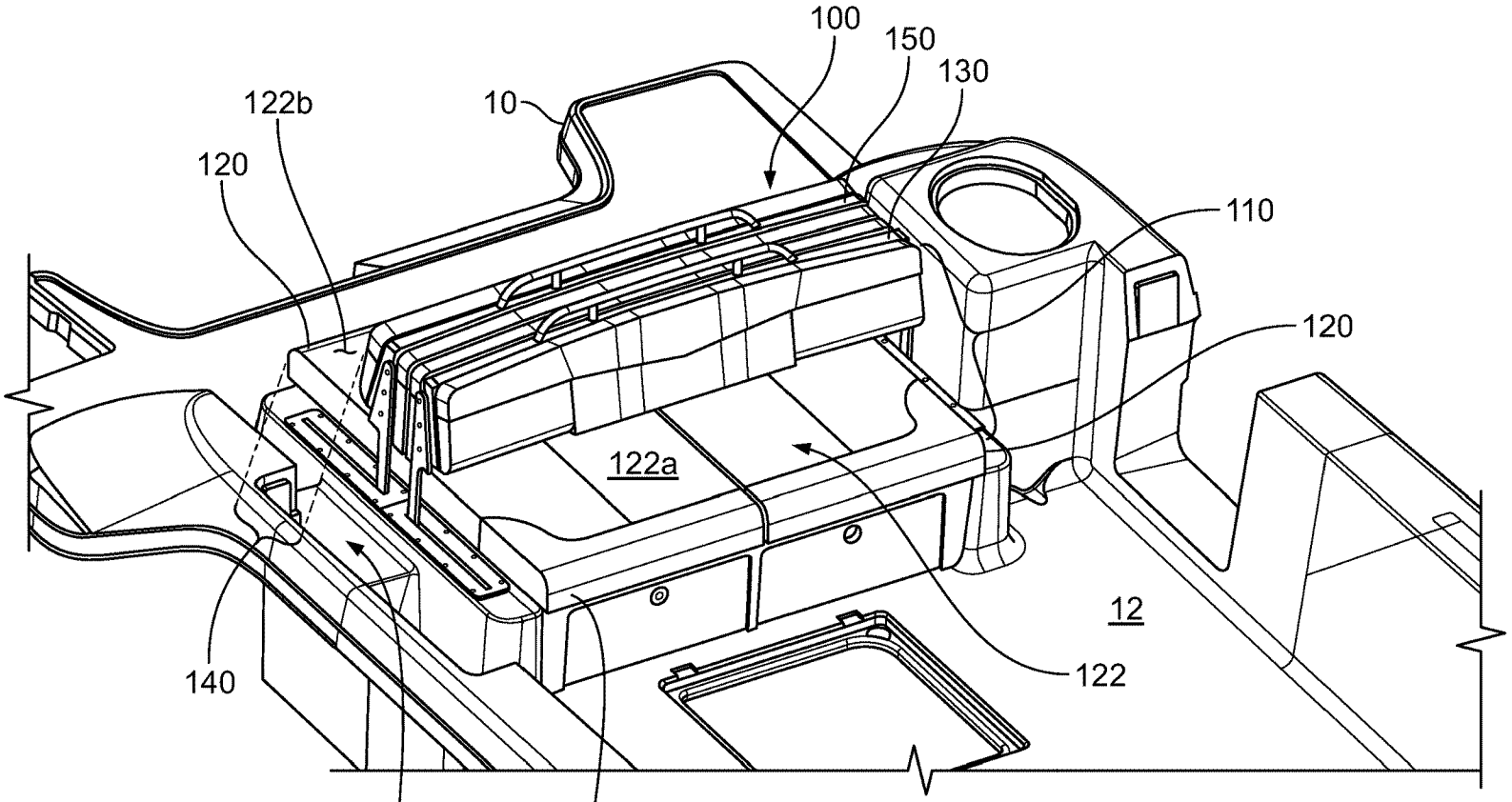
FIG. 1 is a perspective view of a boat-mounted seating assembly in accordance with some embodiments. The seating assembly is configured as back-to-back seats.

Referring to FIG. 1, a boat 10 can include an example seating assembly 100. In the depicted implementation, the seating assembly 100 is attached to a deck 12 of the boat 10 in a rear portion of the boat 10. The seating assembly 100 can be used in a variety of different types of boats (e.g., runabouts, pontoon boats, ski boats, sailboats, bow riders, inboards, outboards, inboard/outboards, jet-boats, yachts, houseboats, and the like). While the seating assembly 100 is shown in the rear (aft area) area of the boat 10, the seating assembly 100 can also be used in other areas of a watercraft (middle areas, front areas, cabin areas, and the like). The seating assembly 100 can be cushioned, covered with water-resistance covering materials, and can include or facilitate various other amenities (e.g., cup holders, contours, handholds, seat belts, and so on) as suitable for the particular implementation and the user's desires.

In the depicted embodiment, the seating assembly 100 laterally spans a majority of the beam (width) of the boat 10. A walkway 14 can be provided along the side of the seating assembly 100 in some embodiments (on either the port side or starboard side). In some embodiments, a walkway is provided along a longitudinal middle portion of the boat 10 such that two seating assemblies 100 are positioned laterally across the boat 10 with a fore-aft walkway in between the two seating assemblies 100. In some embodiments, the seating assembly 100 spans essentially an entirety of the beam of the boat 10.

The seating assembly 100 can be constructed in a variety of widths. In some embodiments, the width of the seating assembly 100 accommodates a single occupant. In the depicted embodiment, the seating assembly is wide enough to accommodate about three or four occupants side-by-side. It should be understood that the seating assembly 100 can be constructed to have any suitable width, e.g., to accommodate one, two, three, four, five, six, seven, eight, or more than eight occupants side-by-side.

The seating assembly 100 can be configured in multiple arrangements. In the depicted configuration, the seating assembly 100 is configured as a forward-facing seat 110 and a rearward-facing seat 140 that are arranged back-to-back. Hence, one or more occupants can be seated in the forward-facing seat 110 and one or more additional occupants can be seated in the rearward-facing seat 140, simultaneously if so desired.

The seating assembly 100 includes a seat bottom 120, a first seat back member 130, and a second seat back member 150. As described further below, the first seat back member 130 is movable in relation to the seat bottom 120. Also, the second seat back member 150 is movable in relation to the seat bottom 120. Moreover, the first seat back member 130 is movable independently from movement of the second seat back member 150. That is, the first seat back member 130 can be moved while the second seat back member 150 is maintained in a stationary location (in relation to the seat bottom 120). Similarly, the second seat back member 150 can be moved while the first seat back member 130 is maintained in a stationary location (in relation to the seat bottom 120). And, if so desired, the first seat back member 130 and the second seat back member 150 can be moved simultaneously (in relation to the seat bottom 120).

The seat bottom 120 includes an upper seating surface 122. In particular, the seat bottom 120 includes a forward portion of the upper seating surface 122*a* and a rearward portion of the upper seating surface 122*b*. The forward portion of the upper seating surface 122*a* forms the forward-facing seat 110 along with the first seat back member 130. The rearward portion of the upper seating surface 122*b* forms the rearward-facing seat 140 along with the second seat back member 150.

In the depicted configuration, the first seat back member 130 and the second seat back member 150 are both located in their full upright positions such that the seating assembly 100 forms the back-to-back seats 110 and 140. From there, the first seat back member 130 can be moved forward and downward, and the second seat back member 150 can be moved rearward and downward. By moving the first seat back member 130 and/or the second seat back member 150 to particular locations, a variety of different seating configurations can be attained, as described further below.

Figure 2:
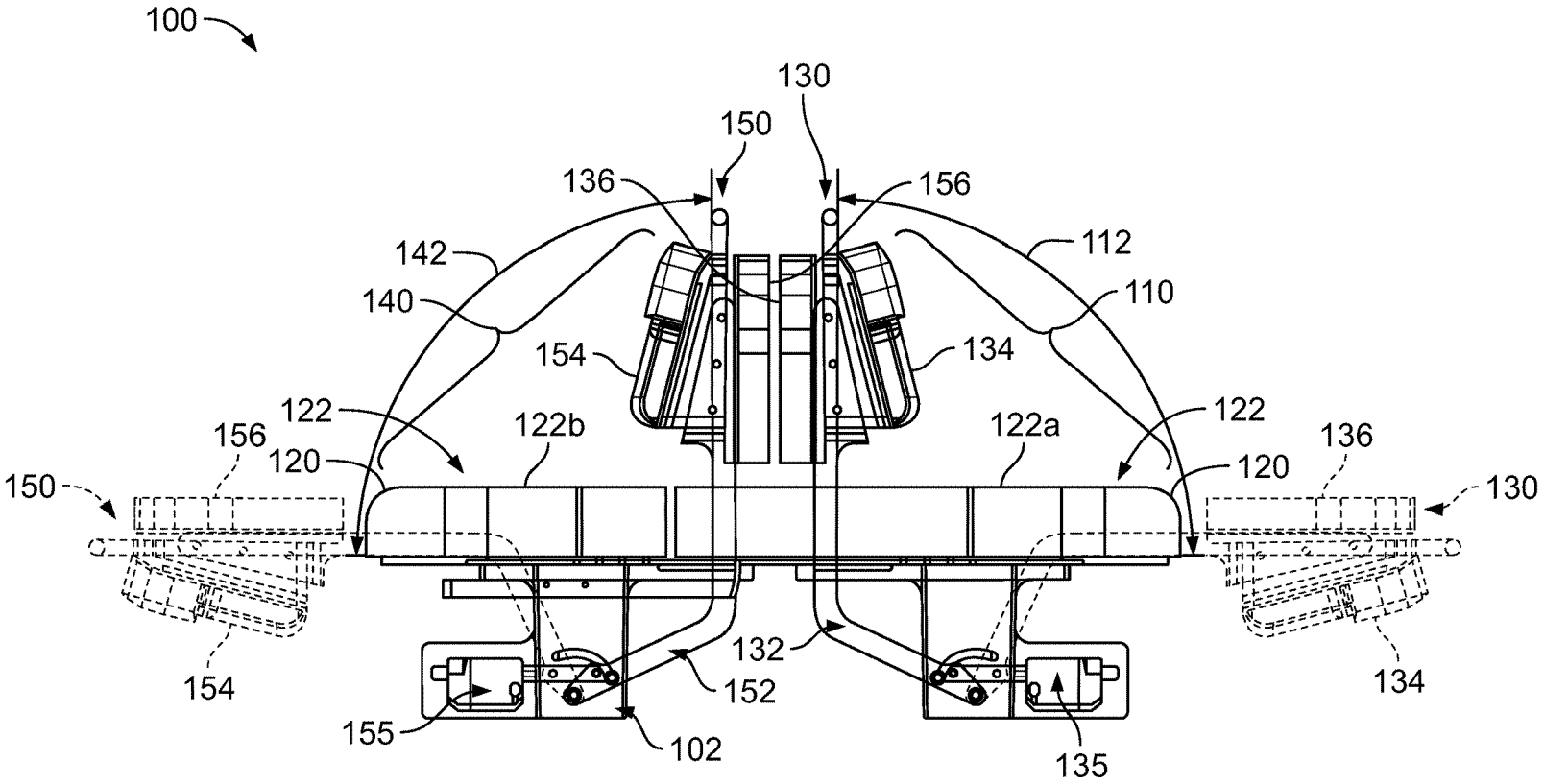
FIG. 2 is a side view of the seating assembly of FIG. 1. The seat backs are shown in two different positions (fully upright and pivoted fully downward).

Referring to FIG. 2, in the depicted embodiment the first seat back member 130 and the second seat back member 150 can be individually pivoted between the fully upright positions (as shown in solid lines) and the fully downward positions (as shown in broken lines). In addition, in the depicted embodiment the first seat back member 130 and the second seat back member 150 can be individually detained, held, or secured in any desired location along their paths of travel between the fully upright positions and the fully downward positions.

In the depicted embodiment, the first seat back member 130 and the second seat back member 150 are individually pivotable in relation to the seat bottom 120. In particular, the first seat back member 130 can be pivoted in relation to the seat bottom 120 to sweep through an angle 112 (and/or portions of the angle 112), and the second seat back member 150 can be pivoted in relation to the seat bottom 120 to sweep through an angle 142 (and/or portions of the angle 142). In some embodiments, the seat back member 130 and 150 can be positioned stationary and detained for use at any location along the sweep angles 112 and 142.

In the depicted embodiment, the angles 112 and 142 are about 90 degrees. In some embodiments, the angles 112 and/or 142 in a range of about 85 degrees to about 95 degrees, or about 80 degrees to about 100 degrees, or about 70 degrees to about 110 degrees, or about 60 degrees to about 120 degrees, or about 70 degrees to about 90 degrees, or about 60 degrees to about 80 degrees, or about 50 degrees to about 70 degrees, without limitation.

The movements of the first seat back member 130 are driven by one or more actuators 135. The movements of the second seat back member 150 are driven by one or more actuators 155. In the depicted embodiment, the actuators 135 and 155 are electric motor driven linear actuators. In some embodiments, other types of actuators can be used such as, but not limited to, rotary actuators, hydraulic actuators, gear motors, and the like. In the depicted embodiment, there are two actuators 135 (one on each side of the first seat back member 130) and two actuators 155 (one on each side of the second seat back member 150). In some embodiments, a single actuator 135 and/or 155 is used for a respective seat back member 130 and/or 150.

User-control of the actuators 135 and 155 can be facilitated using various types of user interface controls. In some embodiments, one or more switches (e.g., push buttons, toggle switches, and the like) can be located on a nearby bulkhead or other portion of the boat 10. In some embodiments, the one or more switches can be located at the cockpit area of the boat 10. In particular embodiments, a wired or wireless remote control unit can be used to actuate movements of the seat back members 130 and 150. In some embodiments, particular configurations of the seating assembly 100 can be stored in memory and, in response to a single button push, the seating assembly 100 will move the first seat back member 130 and/or the second seat back member 150 as needed to attain the particular configurations.

While in the depicted embodiment, the first seat back member 130 and the second seat back member 150 are pivotable in relation to the seat bottom 120, in some embodiments the first seat back member 130 and/or the second seat back member 150 can be movable in other ways. For example, in some embodiments the first seat back member 130 and/or the second seat back member 150 can be translated along (moved along) a track, detached and then reattached in the desired location, or otherwise movable.

The seating assembly 100 includes a base 102. The base 102 supports the seating portions of the seating assembly 100, and mounts the seating assembly 100 to the deck 12 (FIG. 1). In some embodiments, the base 102 is constructed of materials such as, but not limited to, stainless steel (e.g., SAE 316, etc.), aluminum, plated steel, composite materials, and the like, and combinations thereof.

In some embodiments, the base 102 is designed to facilitate space for storage under the seat bottom 120. For example, in the depicted embodiment one or more drawers are located under the forward portion of the upper seating surface 122*a*, and the rearward portion of the upper seating surface 122*b* can be pivoted to access storage space there below.

The first seat back member 130 and the second seat back member 150 include arms 132 and 152 respectively. The arms 132 and 152 are pivotably linked to the one or more actuators 135 and 155 respectively. The arms 132 and 152 mechanically support the other portions of the first seat back member 130 and the second seat back member 150, and facilitate the movements of the first seat back member 130 and the second seat back member 150 in relation to the seat bottom 120. In some embodiments, the arms 132 and 152 are constructed of materials such as, but not limited to, stainless steel (e.g., SAE 316, etc.), aluminum, plated steel, composite materials, and the like, and combinations thereof.

The first seat back member 130 includes a first seat back surface 134 that faces forward while the seating assembly 100 is configured as back-to-back seats (as shown in FIG. 2) and a second seat back surface 136 that faces rearward while the seating assembly 100 is configured as back-to-back seats. The second seat back member 150 includes a third seat back surface 156 that faces forward while the seating assembly 100 is configured as back-to-back seats (as shown in FIG. 2) and a fourth seat back surface 154 that faces rearward while the seating assembly 100 is configured as back-to-back seats.

When the seating assembly 100 is configured as back-to-back seats, the first seat back surface 134 and the forward portion of the upper seating surface 122*a* comprise the forward-facing seat 110. Also when the seating assembly 100 is configured as back-to-back seats, the fourth seat back surface 154 and the rearward portion of the upper seating surface 122*b* comprise the rearward-facing seat 140.

As depicted by the broken lines in FIG. 2, when the seating assembly 100 is configured as a substantially flat surface, the upper seating surface 122, the second seat back surface 136, and the third seat back surface 156 make up portions of the substantially flat surface.

Figure 3:
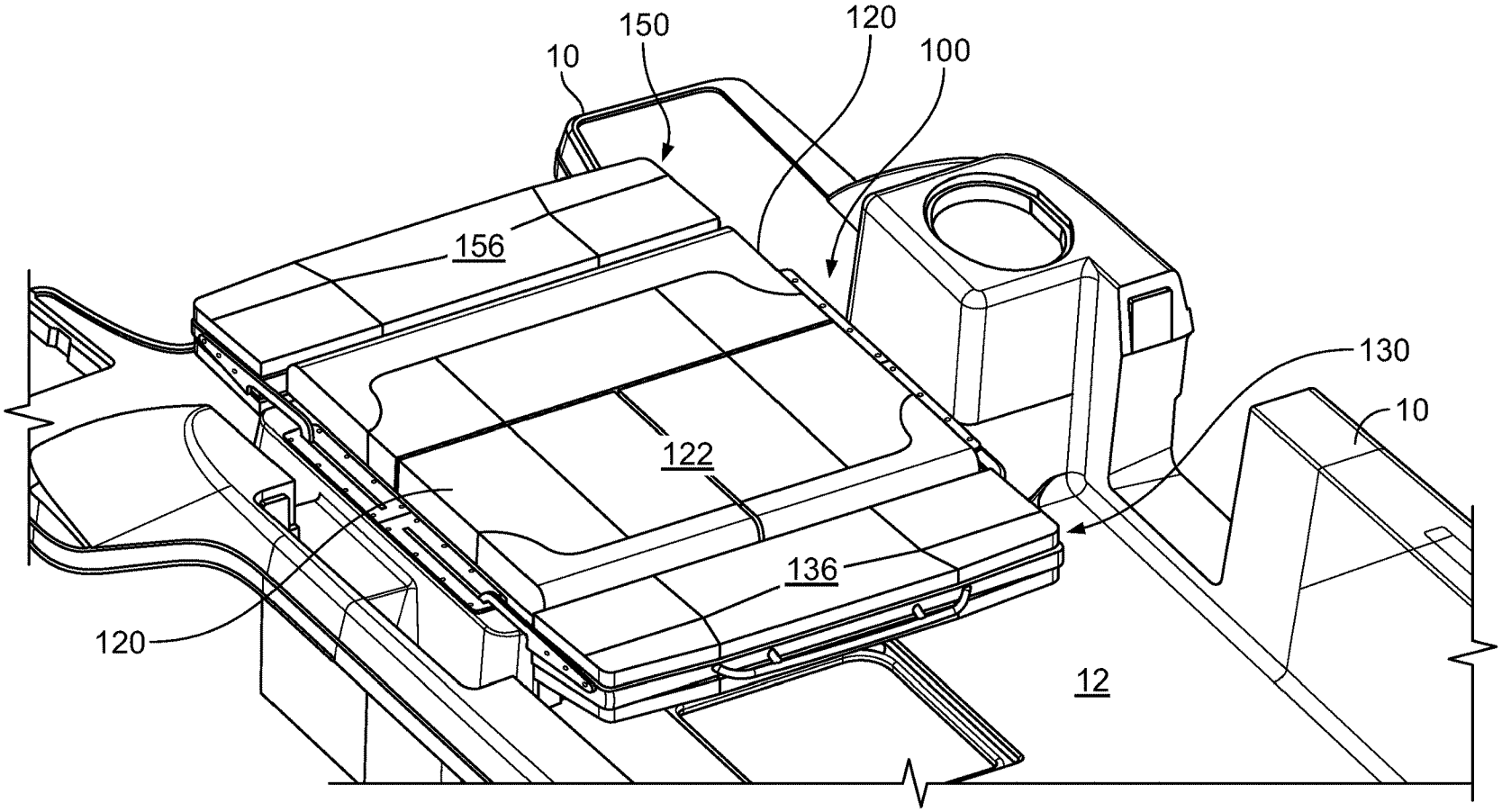
FIG. 3 is another perspective view of the boat-mounted seating assembly of FIG. 1. The seating assembly is configured as a substantially flat surface for sun bathing.

Referring to FIG. 3, the seating assembly 100 can be configured as a substantially flat surface. Such a configuration can be desirable for sun bathing for example.

In the substantially flat surface configuration, the first seat back member 130 and the second seat back member 150 are pivoted fully downward. In result, the second seat back surface 136 is substantially coplanar with the upper seating surface 122, and the third seat back surface 156 is substantially coplanar with the upper seating surface 122.

If the user desires, one or both of the first seat back member 130 and the second seat back member 150 can be pivoted upward a little (e.g., about 5-10 degrees) to provide slight elevation for a comfortable headrest, or a footrest. In one such example, the first seat back member 130 can be pivoted upward about 10 degrees to provide a pillow-like headrest for occupants who are laying on the seating assembly 100 with their feet at the rearward end of the seating assembly 100 (i.e., near the third seat back surface 156).

Figure 4:
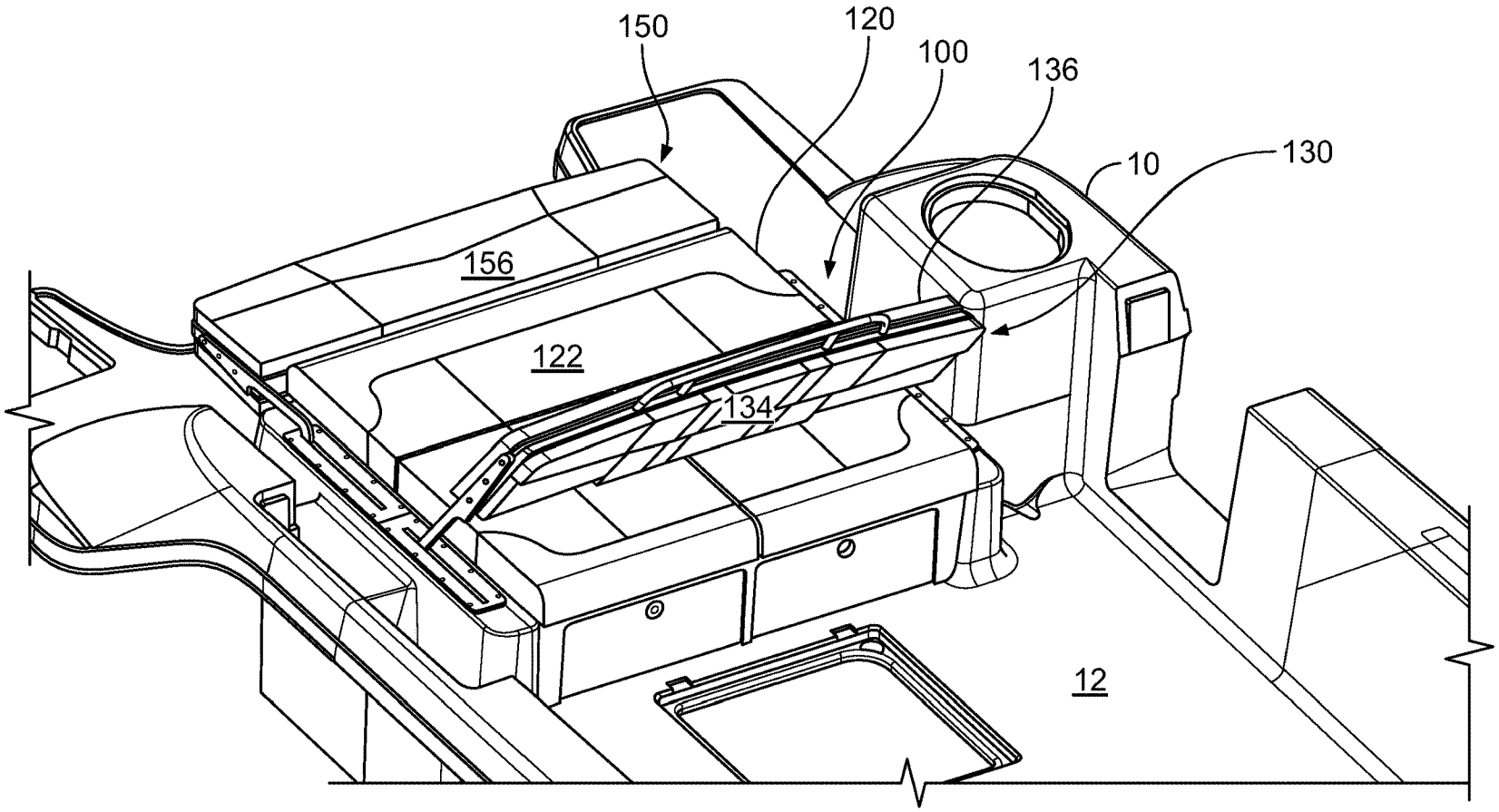
FIG. 4 is another perspective view of the boat-mounted seating assembly of FIG. 1. The seating assembly is configured as a rearward-facing lounge seat arrangement.

Referring to FIG. 4, the seating assembly 100 can also be configured as a rearward-facing lounge seat arrangement. In the rearward-facing lounge seat arrangement, the first seat back member 130 is pivoted partially upward to provide a reclined backrest, and the second seat back member 150 is pivoted fully downward. The third seat back surface 156 and the upper seating surface 122 of the seat bottom 120 make up portions of a substantially planar surface. The second seat back surface 136 provides the reclined backrest surface. It should be understood that the first seat back member 130 can be pivoted to, and detained in, any desired location in relation to the seat bottom 120. Similarly, if the occupant(s) desires to elevate the feet area, the second seat back member 150 can be pivoted upward a little (e.g., about 5-10 degrees) to provide slight elevation.

Figure 5:
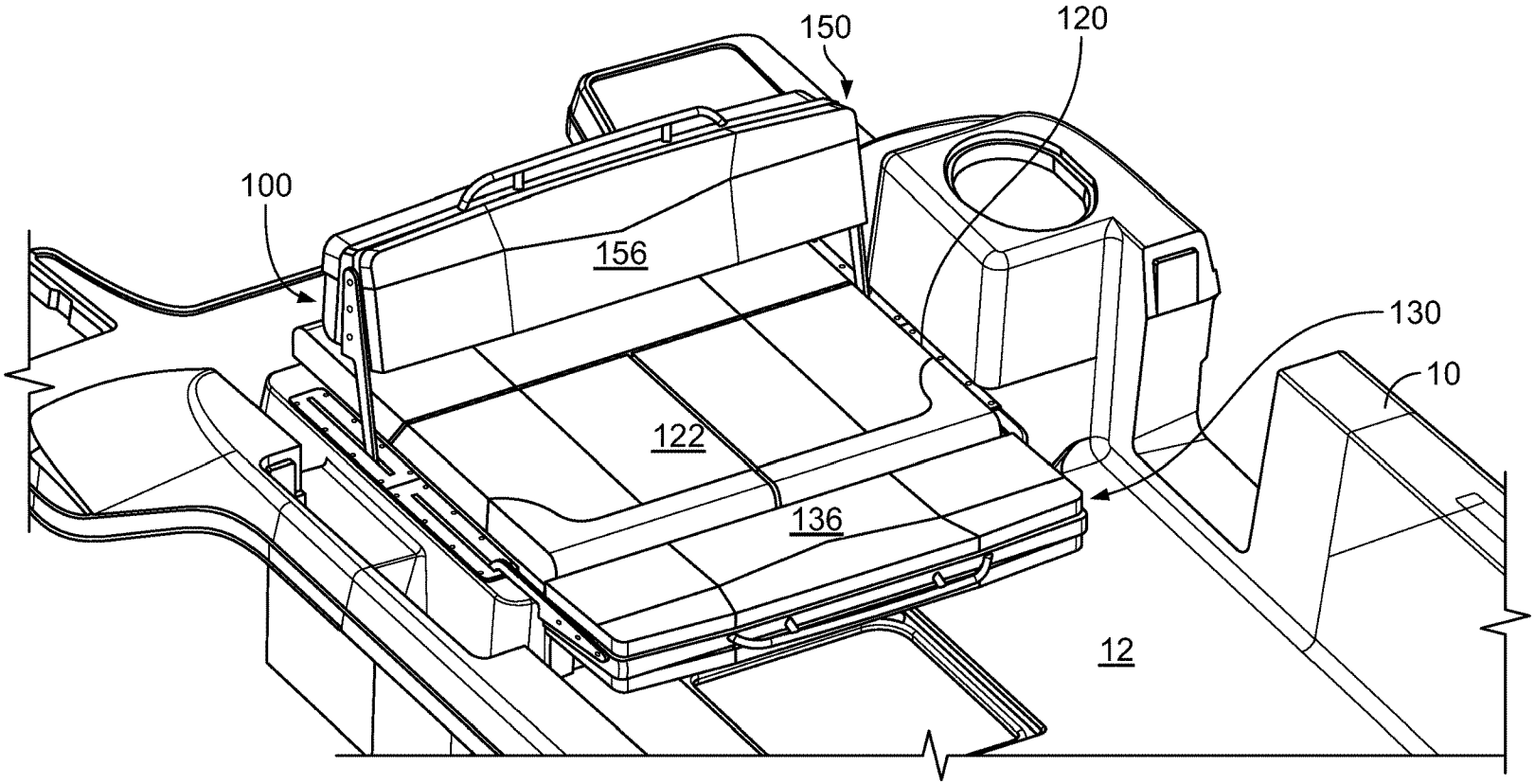
FIG. 5 is another perspective view of the boat-mounted seating assembly of FIG. 1. The seating assembly is configured as a forward-facing lounge seat arrangement.

Referring to FIG. 5, the seating assembly 100 can also be configured as a forward-facing lounge seat arrangement. In the forward-facing lounge seat arrangement, the second seat back member 150 is pivoted partially upward to provide a reclined backrest, and the first seat back member 130 is pivoted fully downward. The second seat back surface 136 and the upper seating surface 122 of the seat bottom 120 make up portions of a substantially planar surface. The third seat back surface 156 provides the reclined backrest surface. It should be understood that the second seat back member 150 can be pivoted to, and detained in, any desired location in relation to the seat bottom 120. Similarly, if the occupant(s) desires to elevate the feet area, the first seat back member 130 can be pivoted upward a little (e.g., about 5-10 degrees) to provide slight elevation.

While this specification contains many specific implementation details, these should not be construed as limitations on the scope of any invention or of what may be claimed, but rather as descriptions of features, that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A watercraft seating assembly comprising:

a seat bottom including an upper seating surface;

multiple seatback members that are reconfigurable between (i) forming back-to-back seats and (ii) forming a substantially flat surface, the multiple seatback members including a first seat back member movable in relation to the seat bottom and a second seatback member movable in relation to the seat bottom, wherein:

while the multiple seatback members are forming the back-to-back seats, the first seat back member has a first seat back surface facing forward and a second seat back surface facing rearward;

while the multiple seatback members are forming the back-to-back seats, the second seat back member has a third seat back surface facing forward and a fourth seat back surface facing rearward; and while the multiple seatback members are forming the substantially flat surface, the upper seating surface, the second seat back surface, and the third seat back surface each comprise portions of the substantially flat surface.

2. The seating assembly of claim 1, wherein, while the seating assembly is forming the substantially flat surface, the upper seating surface is between the second seat back surface and the third seat back surface.

3. The seating assembly of claim 1, wherein, while the seating assembly is forming the back-to-back seats, the second seat back surface faces the third seat back surface.

4. The seating assembly of claim 1, wherein the first seat back member and the second seat back member are movable in relation to the seat bottom independently of each other.

5. The seating assembly of claim 4, wherein the first seat back member and the second seat back member are each pivotable in relation to the seat bottom.

6. The seating assembly of claim 1, wherein, while the seating assembly is forming the back-to-back seats, a forward portion of the upper seating surface and the first seat back surface form a forward-facing seat, and a rearward portion of the upper seating surface and the fourth seat back surface form a rearward-facing seat.

7. The seating assembly of claim 1, wherein the seating assembly is configurable in a forward-facing lounge seat arrangement in which: (i) a forward portion of the upper seating surface and the second seat back surface comprise a substantially flat lounge seat surface and (ii) the third seat back surface comprises a lounge seat back that is positioned in a reclined orientation between the third seat back surface's respective orientations while in the back-to-back seats and the substantially flat surface configurations.

8. The seating assembly of claim 1, wherein the seating assembly is configurable in a rearward-facing lounge seat arrangement in which: (i) a rearward portion of the upper seating surface and the third seat back surface comprise a substantially flat lounge seat surface and (ii) the second seat back surface comprises a lounge seat back that is positioned in a reclined orientation between the second seat back surface's respective orientations while in the back-to-back seats and the substantially flat surface configurations.

9. A watercraft seating assembly comprising:

a seat bottom member including an upper seating surface;

a first seat back member movable relative to the seat bottom member; and a second seat back member movable relative to the seat bottom member, wherein the seating assembly is configurable in a substantially flat configuration in which the seat bottom member is disposed between the first and second seat back members such that the upper seating surface and the first and second seat back members form a substantially planar upper surface, and wherein the seating assembly is configurable as two back-to-back seats each comprising a respective portion of the upper seating surface and a seat back surface of either the first seat back member or the second seat back member.

10. The seating assembly of claim 9, wherein the seating assembly is reconfigurable from the substantially flat configuration to the back-to-back seats configuration by pivoting the first and second seat back members toward each other.

11. The seating assembly of claim 10, wherein the first and second seat back members each pivot at least 60 degrees when reconfiguring from the substantially flat configuration to the back-to-back seats configuration.

12. The seating assembly of claim 9, wherein the seating assembly is reconfigurable from the back-to-back seats configuration to the substantially flat configuration by pivoting the first and second seat back members away from each other.

13. The seating assembly of claim 12, wherein the first and second seat back members each pivot at least 60 degrees when reconfiguring from the back-to-back seats configuration to the substantially flat configuration.

14. A watercraft comprising:

a deck; and a seating assembly attached to the deck, the seating assembly comprising:

a seat bottom member including an upper seating surface;

a first seat back member movable relative to the seat bottom member; and a second seat back member movable relative to the seat bottom member, wherein the seating assembly is configurable in a substantially flat configuration in which the seat bottom member is disposed between the first and second seat back members such that the upper seating surface and the first and second seat back members form a substantially planar upper surface, and wherein the seating assembly is configurable as two back-to-back seats each comprising a respective portion of the upper seating surface and a seat back surface of either the first seat back member or the second seat back member.

15. The watercraft of claim 14, wherein the two back-to-back seats comprise a first seat that faces toward a front of the watercraft and a second seat that faces toward a rear of the watercraft.

16. The watercraft of claim 14, wherein the seating assembly extends laterally across a majority of a beam of the watercraft.

17. The watercraft of claim 14, wherein one or more storage compartments reside under the seat bottom member and above the deck.

18. The watercraft of claim 14, further comprising:

one or more first motorized actuators that pivot the first seat back member when the seating assembly is reconfiguring between the back-to-back seats configuration and the substantially flat configuration; and one or more second motorized actuators that pivot the second seat back member when the seating assembly is reconfiguring between the back-to-back seats configuration and the substantially flat configuration.

19. The watercraft of claim 14, wherein the first and second seat back members each pivot at least 75 degrees when reconfiguring between the back-to-back seats configuration and the substantially flat configuration.

* * * * *